US009056243B2

(12) United States Patent
Kurtz

(10) Patent No.: US 9,056,243 B2
(45) Date of Patent: Jun. 16, 2015

(54) PACKAGED PUZZLE

(71) Applicant: Howard Kurtz, Los Angeles, CA (US)

(72) Inventor: Howard Kurtz, Los Angeles, CA (US)

(73) Assignee: Pigment & Hue, Inc., Inglewood, CA (US)

( * ) Notice: Subject to any disclaimer, the term of this patent is extended or adjusted under 35 U.S.C. 154(b) by 250 days.

(21) Appl. No.: 13/728,626

(22) Filed: Dec. 27, 2012

(65) Prior Publication Data

US 2014/0183819 A1 Jul. 3, 2014

(51) Int. Cl.

| | |
|---|---|
| ***B65D 77/00*** | (2006.01) |
| ***B65D 69/00*** | (2006.01) |
| ***A63F 9/10*** | (2006.01) |
| *A63F 3/00* | (2006.01) |

(52) U.S. Cl.

CPC ..... *A63F 9/1044* (2013.01); *A63F 2003/00252* (2013.01); *A63F 2009/105* (2013.01)

(58) Field of Classification Search

CPC ..... A63F 9/1044; A63F 2009/1005; A63F 2003/00252; A63F 2009/105; B65D 85/00; B42D 15/045

USPC ..... 206/315.1, 457, 223, 216, 579, 575; 273/156, 153 R; 229/103, 117.01, 229/108.1

See application file for complete search history.

(56) References Cited

U.S. PATENT DOCUMENTS

| | | | | |
|---|---|---|---|---|
| 717,105 | A | | 12/1902 | Mansfield |
| 1,907,382 | A | | 5/1933 | Birdsall |
| 1,948,962 | A | | 2/1934 | Decker |
| 2,280,793 | A | | 4/1942 | Carruth |
| 2,984,489 | A | | 5/1961 | Parlato |
| 2,995,238 | A | | 8/1961 | Casselman |
| 3,100,642 | A | | 8/1963 | Goldstein |
| 3,157,343 | A | | 11/1964 | Kendall |
| 3,254,434 | A | | 6/1966 | Gintoft |
| 3,677,399 | A | * | 7/1972 | Tatar ..... 206/232 |
| 3,704,892 | A | | 12/1972 | Moravick et al. |
| 4,140,317 | A | | 2/1979 | Ramney |
| 4,177,917 | A | | 12/1979 | Webinger |
| 4,323,154 | A | * | 4/1982 | Brandenfels ..... 206/216 |
| 4,333,652 | A | | 6/1982 | Clancy |
| 4,385,467 | A | | 5/1983 | Samuels |
| 4,486,018 | A | | 12/1984 | Keller, Jr. |
| 4,943,063 | A | | 7/1990 | Moreau |
| 4,984,798 | A | | 1/1991 | Silberstein |
| 5,156,698 | A | | 10/1992 | Roberts |
| 5,232,088 | A | * | 8/1993 | Leondidis ..... 206/223 |
| 5,246,161 | A | | 9/1993 | Kapp |

(Continued)

OTHER PUBLICATIONS

Berkshire Puzzle Co., "History of the Jigsaw Puzzle," http://www.berkshirepuzzles.com/history_of_the_jigsaw_puzzle. html, printed Sep. 9, 2008, 2pp.

(Continued)

*Primary Examiner* — Mickey Yu
*Assistant Examiner* — Chun Cheung
(74) *Attorney, Agent, or Firm* — SoCal IP Law Group LLP; Steven C. Sereboff; Guy L. Cumberbatch

(57) ABSTRACT

Puzzles that are packaged in assembled form and in a generally flat configuration are described herein. The puzzle package includes one or more flattened box components that provide support backing to the assembled puzzle. The box components have removable portions that provide structural rigidity to the puzzle pieces and are removable to transform the box components into a container for the puzzle pieces.

13 Claims, 10 Drawing Sheets

(56) References Cited

U.S. PATENT DOCUMENTS

| | | | | | |
|---|---|---|---|---|---|
| 5,249,802 | A | * | 10/1993 | McCarthy | 273/157 R |
| 5,255,841 | A | * | 10/1993 | Ritter | 229/103 |
| 5,368,301 | A | | 11/1994 | Mitchell | |
| 5,425,499 | A | | 6/1995 | Pfieffer | |
| 5,725,382 | A | | 3/1998 | Walter et al. | |
| 5,957,454 | A | | 9/1999 | Libeskind | |
| 6,086,067 | A | | 7/2000 | Benoit et al. | |
| 6,213,465 | B1 | | 4/2001 | Jacoby | |
| 6,336,631 | B1 | | 1/2002 | Volkert | |
| 6,431,359 | B1 | | 8/2002 | Hollander | |
| 6,474,641 | B1 | | 11/2002 | Kellock | |
| 6,672,588 | B1 | | 1/2004 | Kielar et al. | |
| 6,755,711 | B2 | | 6/2004 | McClung et al. | |
| 7,011,215 | B2 | | 3/2006 | Meissen et al. | |
| 7,410,062 | B2 | | 8/2008 | Monk | |
| 2007/0057458 | A1 | | 3/2007 | Haag | |
| 2007/0152400 | A1 | | 7/2007 | Cooper | |
| 2008/0136099 | A1 | | 6/2008 | Frost | |
| 2011/0042893 | A1 | * | 2/2011 | Someya | 273/157 R |

OTHER PUBLICATIONS

Dixon, Angie, "The History of Jigsaw Puzzles," http://jigzoneshop.com/catalog/article_info.php?articles_id=13, printed Sep. 9, 2008, 2pp.

McAdam, Daniel, "History of Jigsaw Puzzles," American Jigsaw Puzzle Society, http://www.jigsaw-puzzle.org/jigsaw-puzzle-history.html, printed Sep. 9, 2008, 3pp.

Wikipedia, "Jigsaw puzzle," http://en.wikipedia.org/wiki/Jigsaw_puzzle, printed Aug. 19, 2008, 4pp.

Williams, Anne D., "Jigsaw Puzzles—A Brief History, . . . 1760s to Modern Day . . . ," http://www.wooden-jigsaw-puzzles.com/mgcpuzzles/puzzle_history, printed Sep. 9, 2008, 8pp.

* cited by examiner

PACKAGED PUZZLE

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

This disclosure relates to puzzles and foldable boxes for containing the puzzle pieces.

2. Description of the Related Art

Puzzles, such as jigsaw puzzles, have typically been packaged in boxes, with a top portion covering a bottom portion. The boxes are often bulky, which makes them inconvenient to store and display, and costly to transport. The boxes are often larger than necessary to hold the puzzle pieces, resulting in inefficient packaging and unnecessary bulkiness. Furthermore, the boxes may be fragile and easily damaged during transport, requiring the boxes to be placed inside a protective container for transport, again increasing costs.

The puzzle boxes themselves are often easily scratched and damaged, which is aesthetically unappealing for retail display. Also, the puzzles are disassembled in the boxes and the final puzzle put together cannot be seen during purchase. A picture of the final puzzle is often provided on the puzzle box, but the picture is a less-than-ideal representation of the finished puzzle, and without the outlines of the individual pieces.

DETAILED DESCRIPTION

An aspect of at least one of the embodiments disclosed herein includes the realization that there remains a need for a puzzle that can be displayed in its assembled form and capable of being packaged and transported efficiently.

Puzzles, such as jigsaw puzzles, that are packaged with the puzzle pieces assembled together and supported by one or more support backings are disclosed herein. The support backings are flat pieces of material, such as cardboard, that provide structural rigidity to brace the loosely assemble puzzle pieces. Furthermore, the support backings can be folded to construct a box container for containing the puzzle pieces.

The shape of the puzzle may be round, which is a less common shape in the puzzle market and offers customers a new choice for their puzzle purchases. The round shape may be beneficial for easy packaging and to minimize the risk of damage to the puzzle. For example, puzzles having sharp corners are more easily bent or damaged during transport and display. Puzzles having circular, oval or other shapes with curved edges may have reduced risk of bending or damaging corners during transport. However, this disclosure is not limited to rounded puzzles and may include other shapes as well, such as square, rectangular, polygonal or other angular shape.

The support backing has a shape corresponding to the shape of the assembled puzzle in order to provide structural support for the entire assembled puzzle. The support backings may include an unfolded box container and supplementary support portions that together provide the desired shape corresponding to the assembled puzzle. The supplementary portions are removed prior to folding the support backings into the box container.

Figure 1:
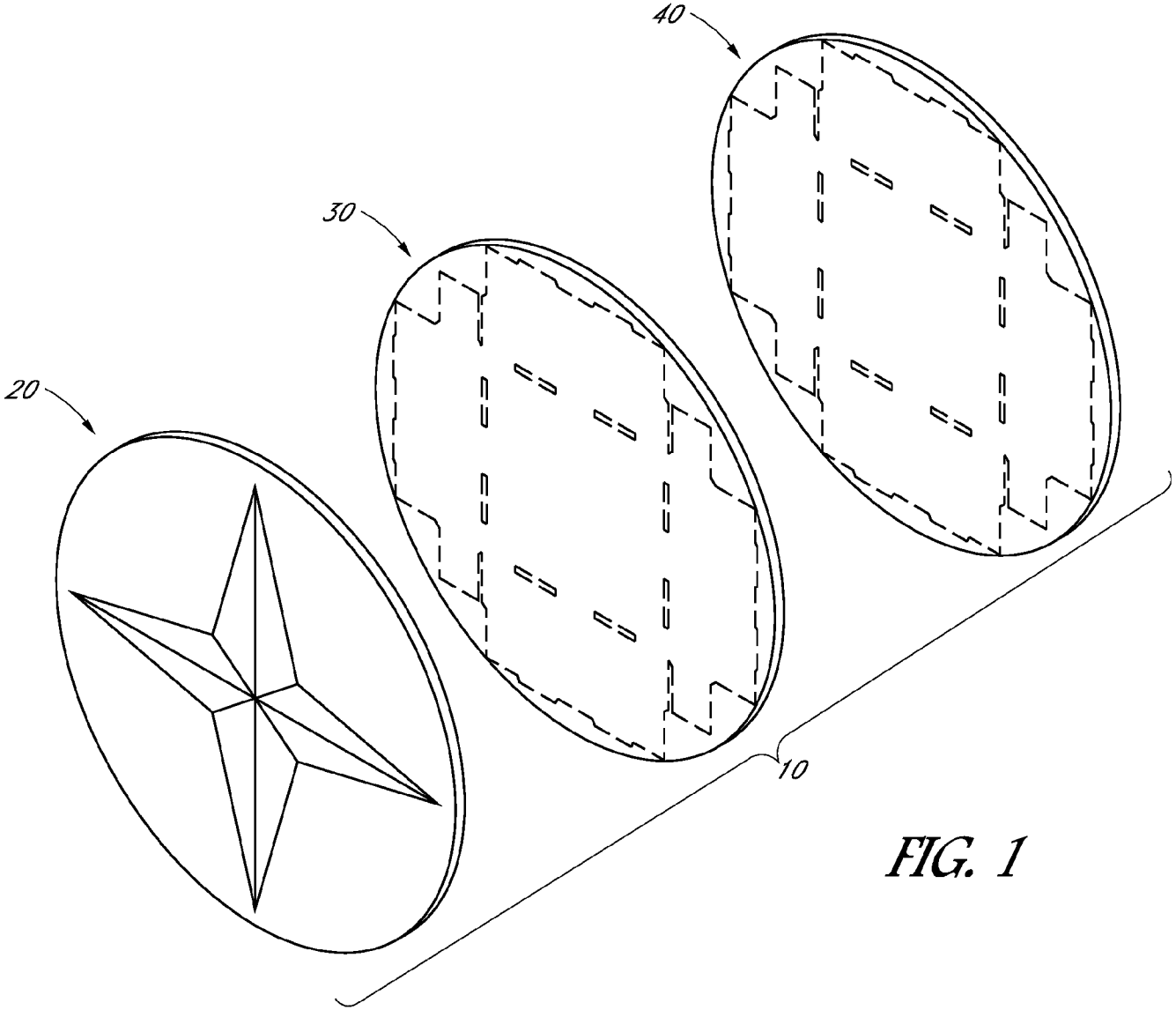
FIG. 1 is an exploded front perspective view illustrating an embodiment of a packaged puzzle and box components.

FIG. 1 illustrates a bundled puzzle package 10 in an exploded perspective view. In addition to the puzzle 20, the package includes a first box component 30 and second box component 40 in a flattened configuration. The box components 30, 40 are packaged in a flattened configuration and can be folded by the user to construct a box for containing the puzzle pieces 22.

Figure 2:
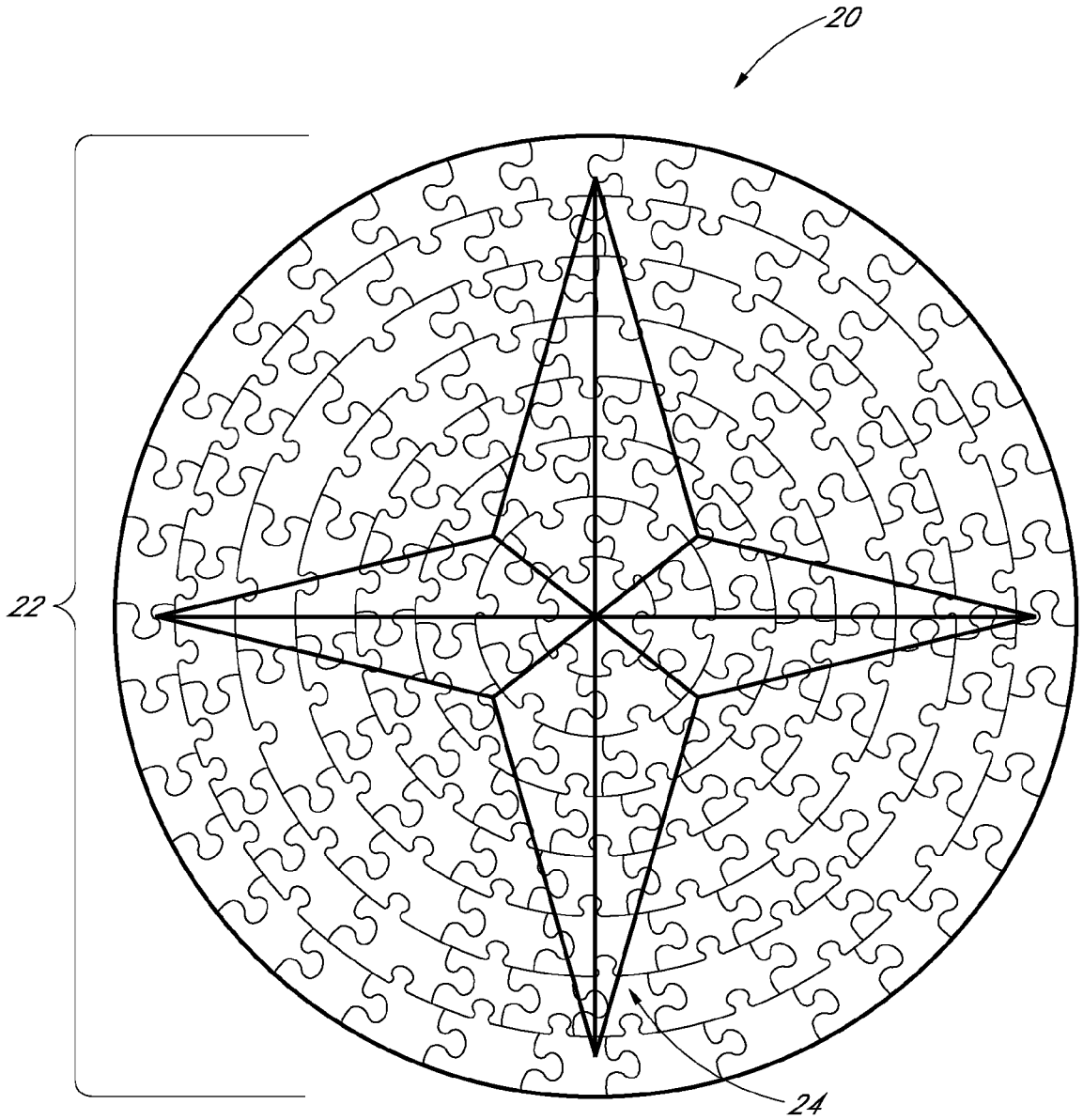
FIG. 2 is a front view illustrating the puzzle of FIG. 1.

The puzzle pieces 22 are packaged assembled together, as illustrated in FIG. 2. The assembled puzzle 20 displays to customers the finished puzzle image 24 and size, allowing customers to see the final assembled puzzle firsthand instead of merely a picture of the puzzle image on a box. The customer is advantageously able to inspect the puzzle to ensure that none of the puzzle pieces are missing. The customer can avoid the frustrating experience of returning a defective puzzle or requesting a replacement puzzle from the manufacturer. The puzzle package 10 may be displayed with the image 24 toward customers and several puzzle packages 10 can be stacked on, or in front of, each other, allowing for efficient display and compact storage of the puzzle packages 10. When a customer takes the top puzzle package for purchase, the puzzle package behind the top package becomes visible for display. Thus, less interaction by retail staff is required to maintain the display.

Figure 3:
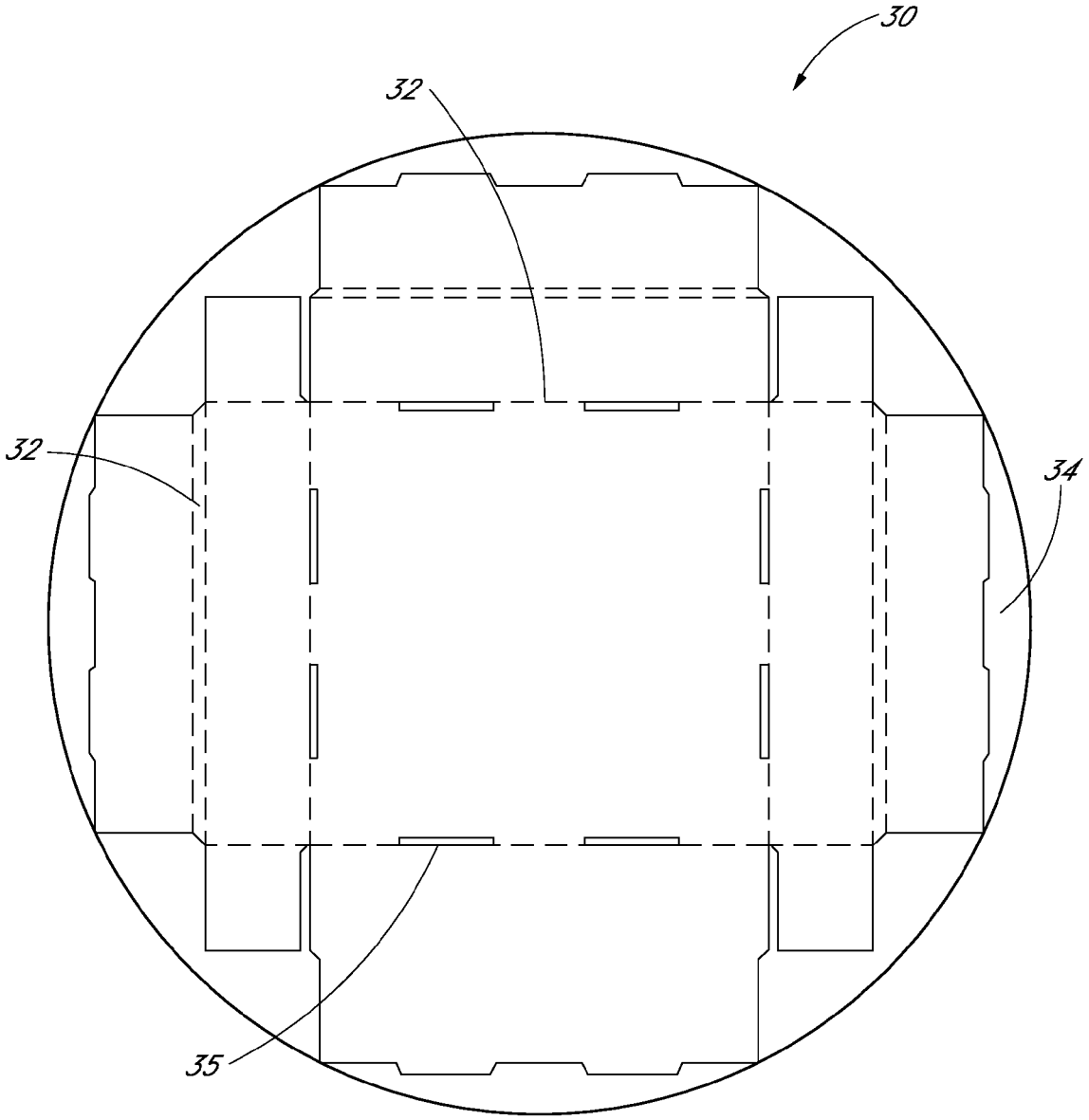
FIG. 3 is a front view illustrating the first box component of FIG. 1.
Figure 4:
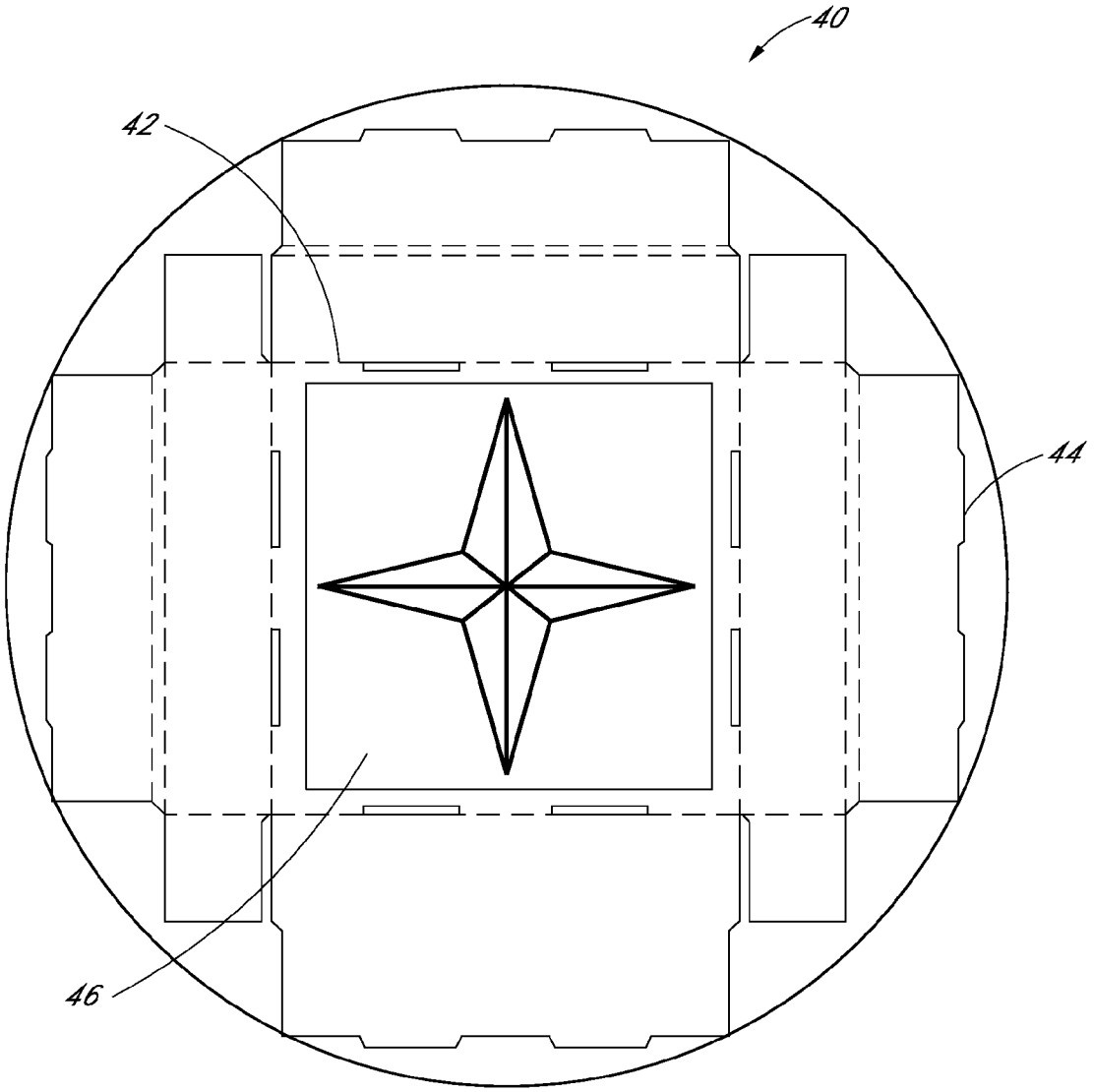
FIG. 4 is a rear view illustrating the second box component of FIG. 1.
Figure 5:
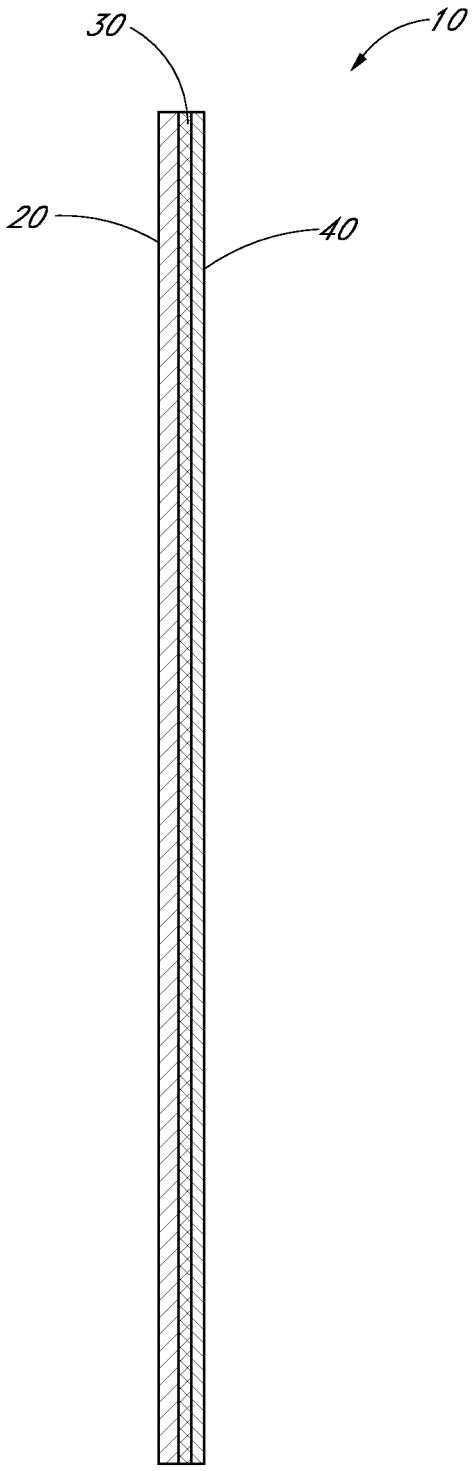
FIG. 5 is a side view illustrating the packaged puzzle and box components of FIG. 1.

FIG. 3 illustrates a first box component 30 and FIG. 4 illustrates a second box component 40. The box components are in a flattened configuration when packaged and provide a support backing to the puzzle 20 to help the puzzle 20 hold its shape and maintain the puzzle pieces 22 together. FIG. 5 is a side view of the puzzle package 10 with the puzzle 20, first box component 30 and the second box component 40 packaged in a thin, flat configuration. The puzzle 20 is adjacent to the two box components and the package 10 may be held together by any of a plurality of different types of methods for holding the puzzle pieces and box components together. The wrap shown in the figures is a transparent plastic wrap that can be shrunk around the puzzle 20 and box components 30, 40 to secure the components together. Other examples of packaging methods include a net, elastic rubber covers, straps and glass and/or plastic cases. The package wrap may be transparent or see-through so that the puzzle image 24 can be seen through the wrap. Preferably, the packaging does not obscure any part of the puzzle, or only obstructs a minor part of the puzzle, so that the majority of the puzzle image 24 is visible through the packaging.

As best illustrated in FIGS. 3 and 4, the box components 30, 40 may have prearranged creases 32, 42 where sides of the box component can be folded over to construct a box container. The creases 32, 42 help form straight folds in the box components to facilitate easier construction of the container.

Figure 6:
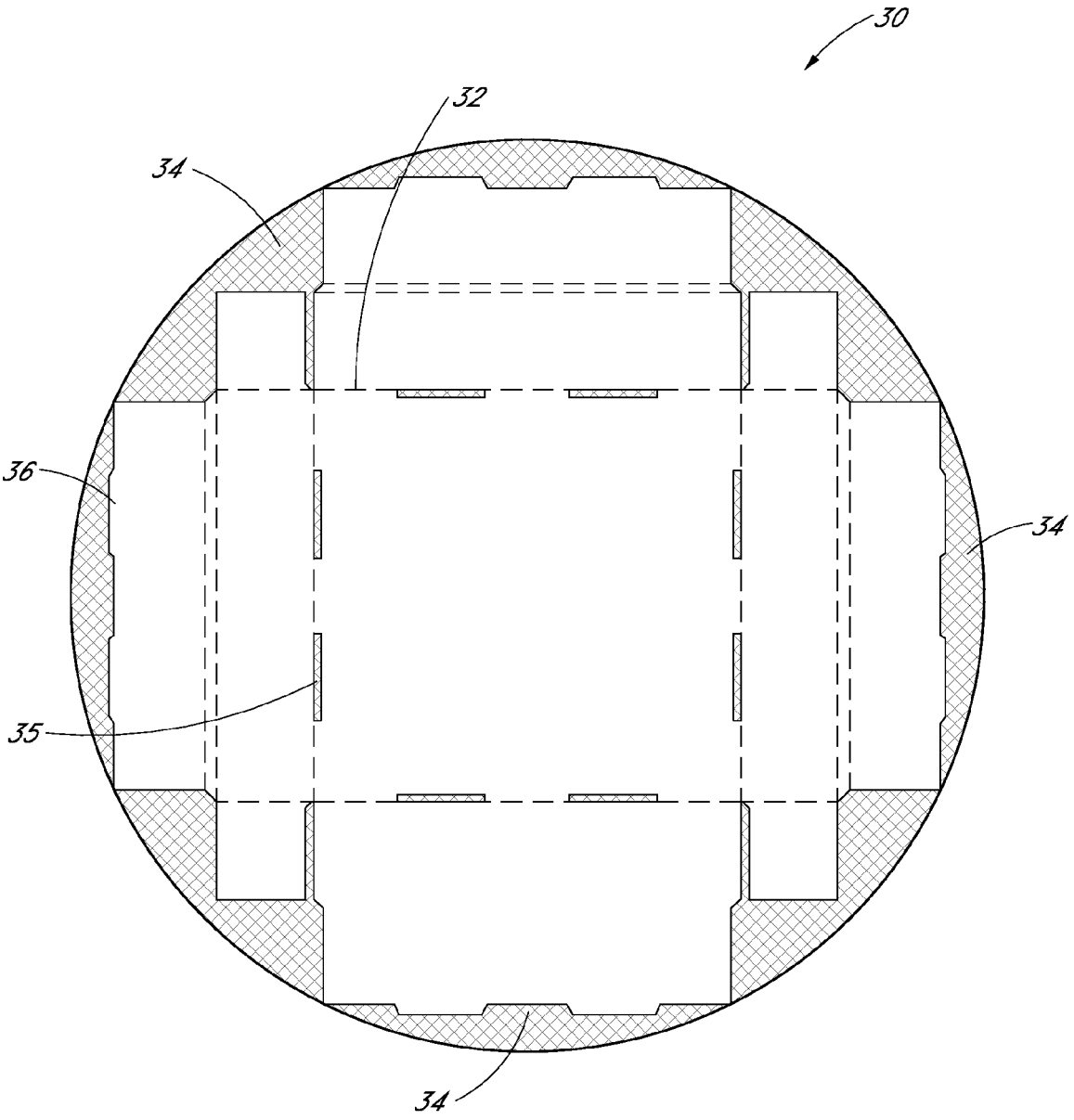
FIG. 6 is a front view illustrating one of the box components of FIG. 1 with the support portions shaded.

The box components may have portions that may be removed before folding the box component into a container. FIG. 6 illustrates the first box component 30 showing the removable pieces 34 as shaded. Perforations along the edges of the removable pieces 34 help to detach the pieces 34 without the use of tools or other supplies. Some of the removable pieces 34 are positioned on the periphery of the first box component 30 and provide the box component a generally round shape to correspond to the shape of the assembled puzzle 20. For assembled puzzles that have other shapes, such as square, rectangle, oval, etc., the removable pieces are configured to give the box component a shape corresponding to the shape of the assembled puzzle. Alternatively, the removable pieces 34 may fold into the first box component 30, but remain a part of the structure of the container.

With continued reference to FIG. 6, the first box component 30 has slots 35 along the inner creases 32 toward the center of the box component. The slots 35 may be covered with strips for transport that can be removed prior to construction. The slots 35 are configured to couple with tabs 36 on the outer edges of the box component to construct the walls of the container, as discussed below. In the embodiment shown in FIG. 6, the first box component 30 has creases 32 configured to fold inward (upward from the page). However, the box components may be folded from a flat configuration to a box container by any of a plurality of different methods. For example, the box components may form a box container shape using adhesive tapes, glues, hook and loop fasteners, other fasteners, etc.

Figure 7:
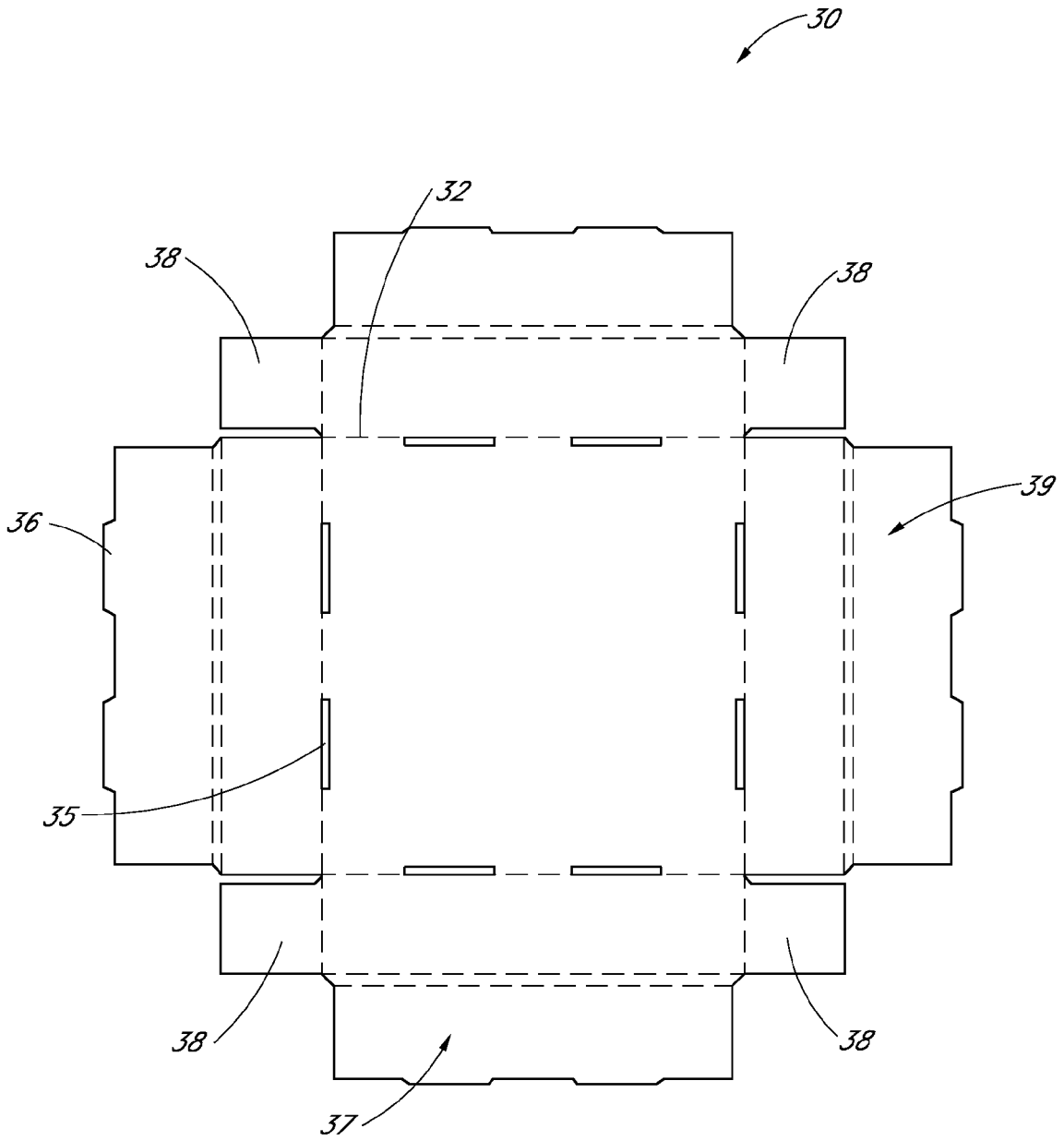
FIG. 7 is a front view illustrating one of the box components of FIG. 1 with the support portions removed.

FIG. 7 shows the removable pieces 34 detached from the first box component 30 to reveal two opposing sides with flaps 37 and two opposing sides without flaps 39. The outer edges of the sides have tabs 36 that are retained by slots 35 at the base of the sides to form the sides of the box component. The two sides with flaps 37 are folded first and the two sides without flaps 39 are folded over the flaps 38 to form an interlocked structure.

Figure 8:
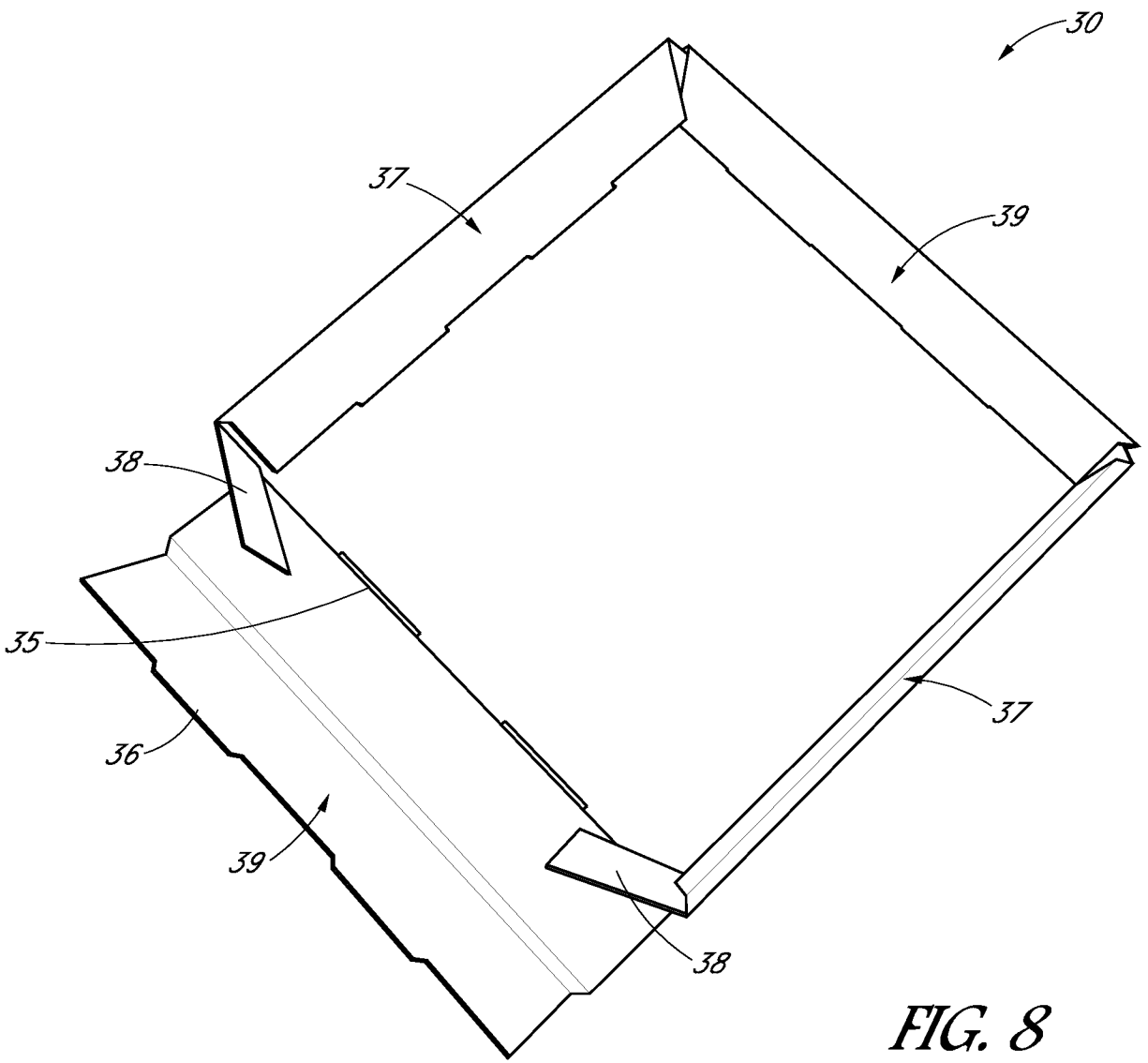
FIG. 8 is a perspective view illustrating one of the box components of FIG. 1 partially constructed.

FIG. 8 illustrates a first box component 30 with three of the four sides constructed. One of the sides without flaps 39 is shown folded over the flaps 38 of the two sides with flaps 37. The remaining side without flaps 39 may be folded over the two flaps 38 to complete the construction of the first box component 30.

Figure 9:
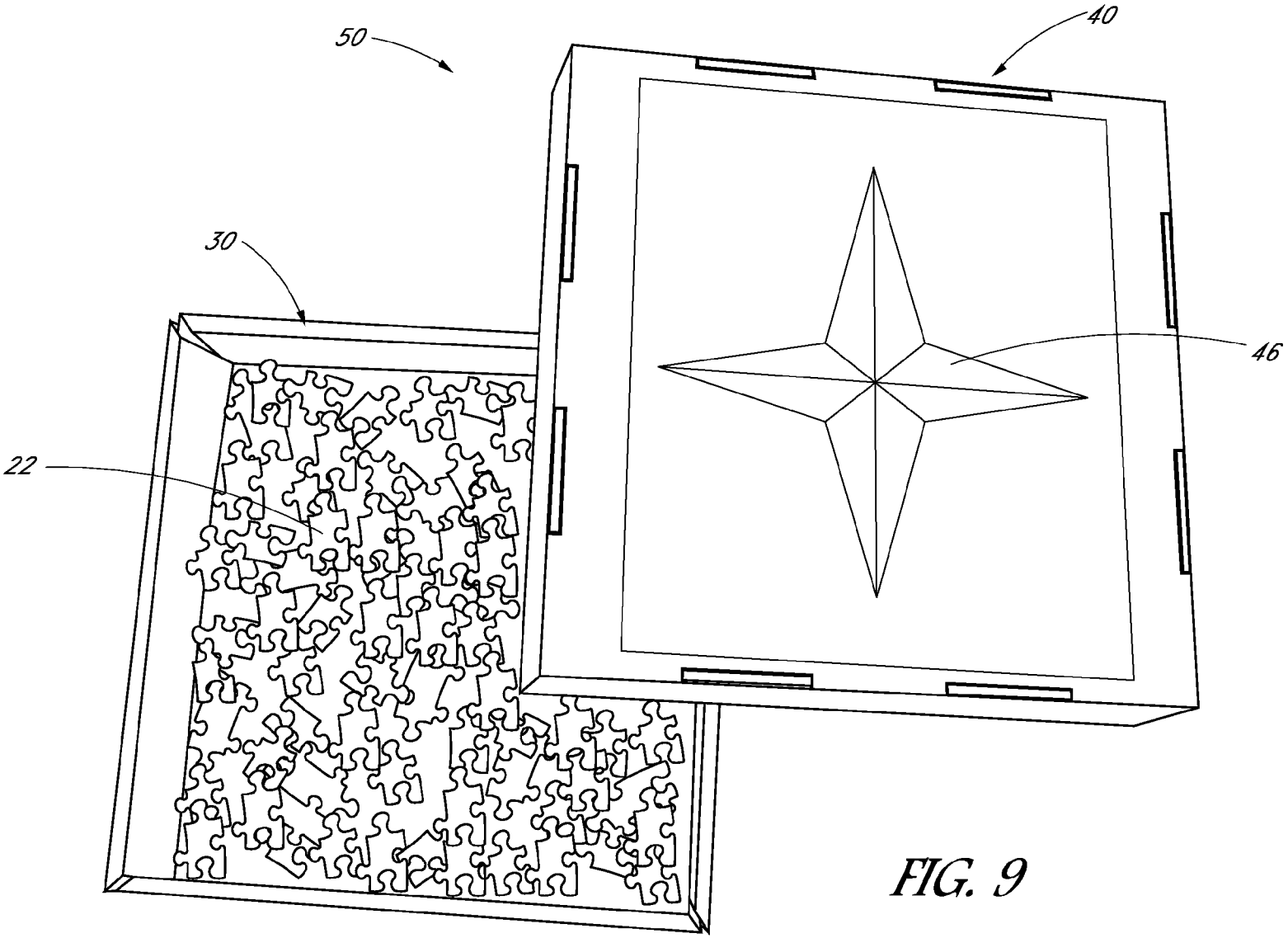
FIG. 9 is a perspective view illustrating the box components of FIG. 1 fully constructed and in an open configuration to show the enclosed puzzle.
Figure 10:
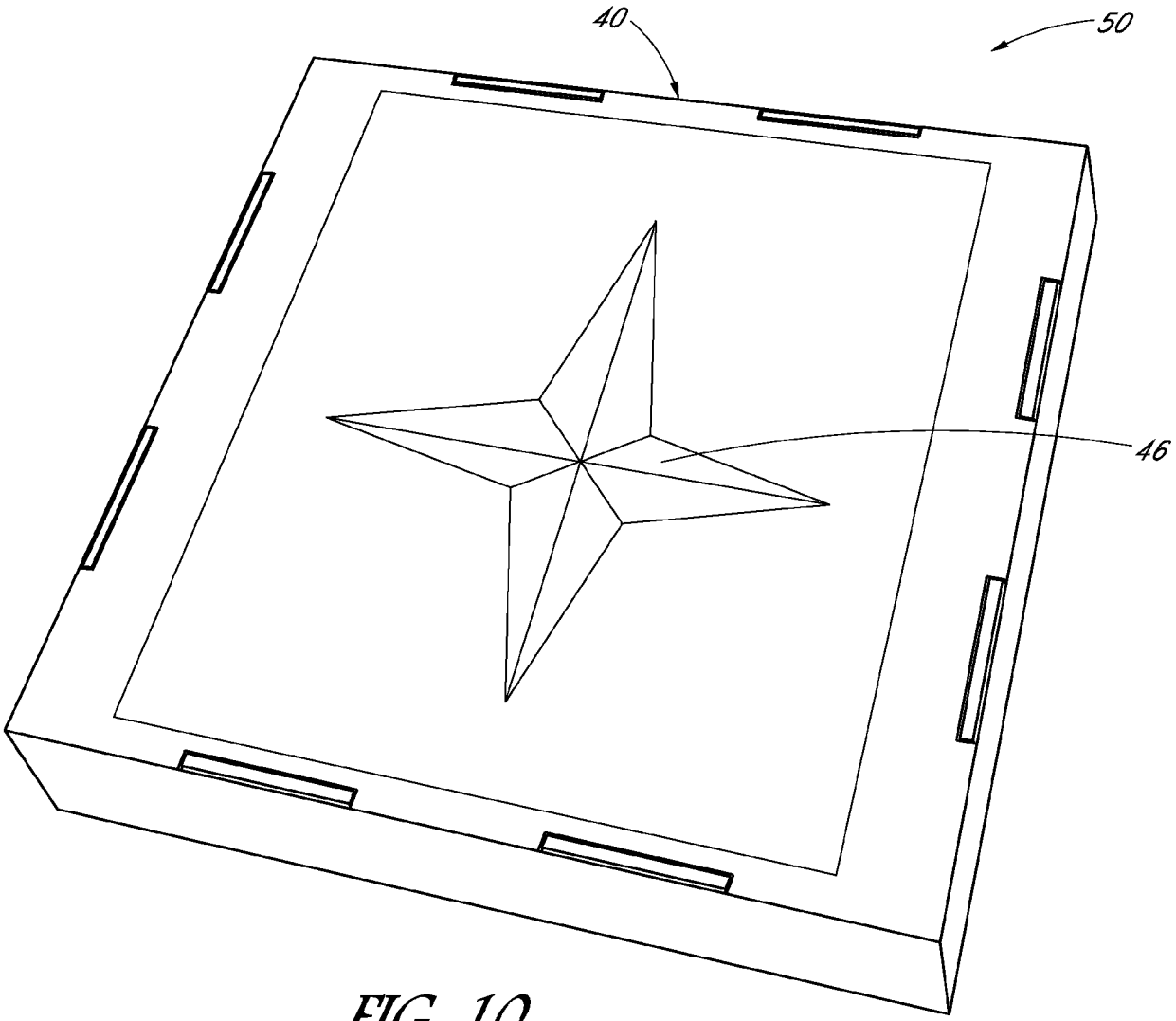
FIG. 10 is a perspective view illustrating the box components of FIG. 9 in a closed configuration.

The second box component 40 may be configured to fold in generally the same method as the first box component 30. However, the second box component 40 may be slightly larger in dimensions so that it can fit over the first box component 30, as illustrated in FIGS. 9 and 10. For example, the first box component 30 may have a width of at least approximately 13 centimeters and/or less than or equal to approximately 18 centimeters. The second box component 40 may have a width of at least approximately 15 centimeters and/or less than or equal to approximately 20 centimeters. In other embodiments, the first box component 30 may have larger dimensions than the second box component 40 so that the first box component 30 fits over the second box component 40.

The second box component 40 may have a picture 46 representing the image of the assembled puzzle. In some cases, such as with fine art paintings, the picture 46 on the box component may show the full painting, whereas the puzzle itself is a cropped version, or detail, of the painting. In some embodiments, the picture 46 may have other items, instead of or in addition to, the graphics of the finished puzzle, such as a description and/or history of the image of the puzzle. When the puzzle and box components are packaged, the second box component 40 may be one of the outer layers and the picture 46 may face outward so that the picture 46 is visible to customers. When the second box component 40 is constructed and coupled with the first box component 30 for storage of the puzzle pieces, the picture 46 can be visible to represent the puzzle pieces inside, as shown in FIGS. 9 and 10. The picture 46 may be on the first box component 30 instead of or in addition to being on the second box component 40.

FIG. 9 shows the first box component 30 and the second box component 40 with the puzzle pieces 22 contained inside the container 50. FIG. 10 shows the second box component 40 mated with the first box component 30 to hold the puzzle pieces securely inside the container 50.

One or both of the first box component 30 and the second box component 40 may have drawings, instructions, warnings, regulatory information, labels, product information, etc. For example, FIG. 4 shows a second box component 40 with a representative picture 46 in the center. Around the center picture 46 may be trademarks or labels with the product name or company name. The title of the puzzle may also be present, along with other descriptive information of the puzzle, such as number of pieces, dimensions, and description of the image. Toward the outer edges of the box component may be instructions on how to construct the box component into a container, as shown in FIG. 4. When the box component is constructed, as shown in FIG. 10, the labels and product information can be visible on the sides of the container 50. The portions of the box component with the assembly instructions may be folded on the inner side of the container, where they are not visible after construction of the container 50. Portions of the instructions may also be on the removable pieces of the box component that are discarded. In some embodiments, the box components may have other items on the box components, such as place of manufacture, warning labels, website address, universal product codes, material compositions, etc.

At least one surface of the box components 30, 40 may have a protective membrane or coating that is preferably waterproof to protect the container from damage. The protective membrane or coating may be made of a wax, a thin plastic, or some other generally impermeable material that resists moisture and provides an attractive appearance to the container when assembled.

The puzzle pieces 22, first box component 30 and second box component 40 may be made from a plurality of different types of materials. For example, cardboard can be used for the puzzle pieces 22 and/or box components 30, 40. Other types of materials may include plastics, paper, wood, textiles, leather, rubber, foam and metals. The puzzle pieces 22 and the box components 30, 40 may be made from the same type of material, or may be made from different types of materials. Furthermore, each component may be made from more than one type of material.

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments. Additionally, it will be recognized that the methods described herein may be practiced in different sequences, and/or with additional devices as desired. Such alternative embodiments and/or uses of the methods and devices described above and obvious modifications and equivalents thereof are intended to be included within the scope of the present invention. Thus, it is intended that the scope of the present invention should not be limited by the particular embodiments described above, but should be determined only by a fair reading of the claims that follow.

What is claimed is:

1. A jigsaw puzzle package comprising:

an assembled puzzle comprising a plurality of pieces that form a puzzle image, the assembled puzzle having a curvilinear shape;

a first box component that is generally flat and having a shape substantially the same as the curvilinear shape of the assembled puzzle and configured to fold into an open box shape, the first box component comprising removable portions that provide backing support to at least some of the plurality of pieces; and a second box component that is generally flat and having a shape substantially the same as the curvilinear shape of the assembled puzzle and configured to fold into an open box shape, the second box component comprising removable portions that provide backing support to at least some of the plurality of pieces, the second box component further comprising a picture of the puzzle image;

wherein the assembled puzzle, first box component and second box component are stacked to overlap one another substantially and the puzzle image of the assembled puzzle faces outward on one side, and wherein the puzzle package is held together by a wrap.

2. The jigsaw puzzle package of claim 1, wherein the curvilinear shape is generally circular.

3. The jigsaw puzzle package of claim 1, wherein the first box component folded in the open box shape is configured to couple with the second box component folded in the open box shape, to form a container suitable to hold the plurality of pieces of the puzzle.

4. The jigsaw puzzle package of claim 1, wherein the wrap is a transparent plastic wrap that is shrunk around the puzzle package.

5. The jigsaw puzzle package of claim 1, wherein the entire puzzle image is unobstructed by the wrap and is fully visible through the wrap.

6. The jigsaw puzzle package of claim 1, wherein the first box component and the second box component are made of a cardboard material.

7. The jigsaw puzzle package of claim 1, wherein the first box component and the second box component further comprise prearranged creases for folding the box components into an open box shape.

8. The jigsaw puzzle package of claim 1, wherein the second box component further comprises at least one of assembly instructions, product warnings, regulatory information, company labels and product information.

9. A puzzle package comprising:

a puzzle comprising a plurality of pieces that form a puzzle image, the puzzle having a generally circular shape when assembled;

a first box component having a flat configuration with a shape substantially the same as the generally circular shape of the assembled puzzle and a folded configuration having an open box shape, wherein in the flat configuration the first box component provides backing support to at least some of the plurality of pieces; and a second box component having a flat configuration with a shape substantially the same as the generally circular shape of the assembled puzzle and a folded configuration having an open box shape, wherein in the flat configuration the second box component provides backing support to at least some of the plurality of pieces;

wherein the first box component is configured to couple with the second box component to form a container suitable to hold the plurality of pieces wherein the assembled puzzle, first box component and second box component are stacked to overlap one another substantially and the puzzle image of the assembled puzzle faces outward on one side.

10. The puzzle package of claim 9, wherein the first box component further comprises removable portions that provide the backing support.

11. The puzzle package of claim 9, wherein the second box component further comprises removable portions that provide the backing support.

12. The puzzle package of claim 9, wherein the second box component further comprises a picture of the puzzle image.

13. The puzzle package of claim 9 wherein the puzzle package is held together by a wrap.

* * * * *